United States Patent [19]

Lesly et al.

[11] 4,418,638

[45] Dec. 6, 1983

[54] WINDOW-DOOR ALARM

[76] Inventors: Michel Lesly, c/o George Spector, 3615 Woolworth Bldg., 233 Broadway; George Spector, 3615 Woolworth Bldg., 233 Broadway, both of New York, N.Y. 10007

[21] Appl. No.: 102,020

[22] Filed: Dec. 10, 1979

[51] Int. Cl.[3] ..... F41F 27/00; G08B 13/08

[52] U.S. Cl. ..... 116/87; 42/1 TB; 116/89

[58] Field of Search ..... 116/87, 89, 86; 42/1 TB, 1 G

[56] References Cited

U.S. PATENT DOCUMENTS

| | | | |
|---|---|---|---|
| 225,641 | 3/1880 | Reiff | 116/83 |
| 364,637 | 6/1887 | Ellwood | 116/87 |
| 368,095 | 8/1887 | Lamb | 116/87 |
| 600,068 | 3/1898 | Goepper | 116/89 |
| 609,994 | 8/1898 | Meyer | 42/1 TB |
| 824,161 | 6/1906 | Wade | 116/83 |
| 896,769 | 8/1908 | Smith | 116/89 |
| 1,456,209 | 5/1923 | Atwood | 116/89 |
| 1,754,305 | 4/1930 | Burrell | 116/89 |
| 3,214,857 | 11/1965 | Tyrone et al. | 42/1 TB |

*Primary Examiner*—Daniel M. Yasich

[57] ABSTRACT

An alarm device which explodes a loud sounding firing cap in case a door or window is started to be opened; the device including a pop gun mechanism wherein a released compression spring inside a barrel strikes an explosion cap inserted in an end of the barrel; the cocked spring mechanism being released by a push of a bar mounted on a movable window sash or door.

1 Claim, 7 Drawing Figures

WINDOW-DOOR ALARM

This invention relates to burglar alarm devices.

It is well known that almost all burglaries of a home are made by an entry in which a door is swung open or a window sash is slided open. Only in rare cases entry is made by removal of the window glass or a door panel, in which cases, the window sash or door framework is not moved. Accordingly, most home burglaries could be aborted by an alarm that is activated by movement of the window sash or door.

Therefore it is a principal object of the present invention to provide such an activated alarm, and which is mechanically set by hand, so to be very inexpensive to purchase and easy to install, thus providing a protection for all persons who cannot afford purchase of the expensive electrical systems now being offered on the market.

Figures 1, 2, 3, 4, 5, 6, 7:
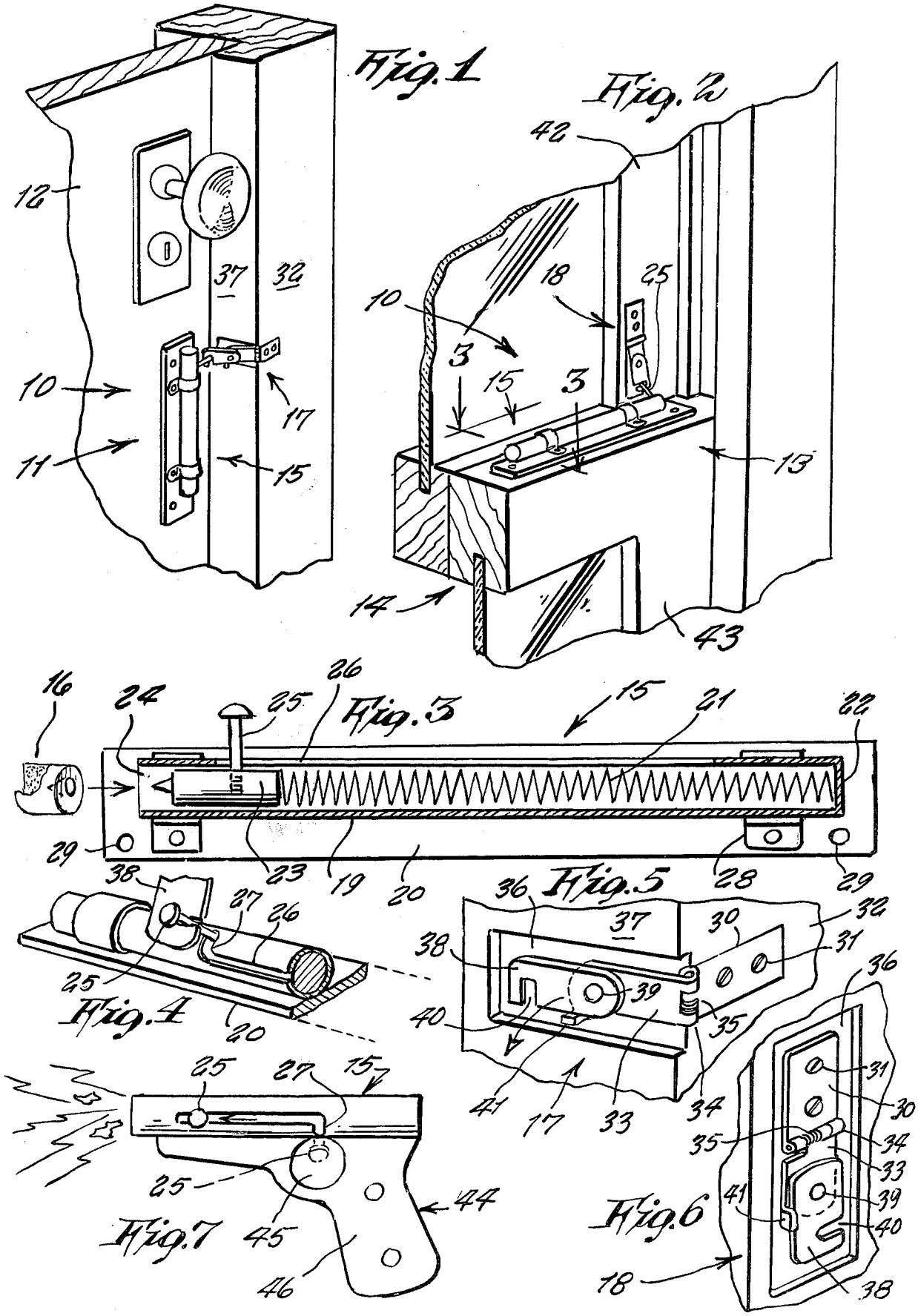
FIG. 1 is a perspective view of the device installed on a door, and shown in a cocked position.
FIG. 2 is a similar view thereof installed on a double hung window, and shown in cocked position.
FIG. 3 is a cross sectional view of line 3—3 of FIG. 2.
FIG. 4 is a fragmentary rear perspective view thereof.
FIG. 5 is an enlarged detail of the triggering unit shown in FIG. 1.
FIG. 6 is an enlarged detail of the triggering mechanism shown in FIG. 2.
FIG. 7 is a side view of a toy pistol shown incorporating the firing mechanism unit of the invention.

Referring now to the drawing in greater detail, the reference numeral 10 represents a protection device according to the present invention which in one design 11 is adapted for protecting a door 12, and which in another design 13 is adapted for protecting a window 14.

Both designs 11 and 13 include a firing mechanism unit 15 for loudly exploding a gun powder loaded firing cap 16. The design 11 additionally includes a triggering unit 17 for activating the firing mechanism unit, while the design 13 includes a triggering unit 18 instead, the unit 17 being particularly made for a window while the unit 18 is made for the door.

The firing mechanism unit comprises a steel barrel 19 munted on a flat base 20. The barrel contains a compression coil spring 21 which at one end bears against the barrel end wall 22 and which at its other end bears against a slidable hammer 23 for striking with force against the firing cap which is squeezed in the open opposite end 24 of the barrel. A sideward pin 25 projecting from the hammer slides in a longitudinal slot 26 of the barrel. A bayonet slot extension 27 at one end of th slot serves to hold the hammer in a cocked position and the spring in a compressed condition.

The barrel is secured on the base by means of clips 28. Holes 29 in the base are provided for nails or screws in other to mount the unit 15 on a door or window.

The triggering unit 17 includes a plate 30 secured by screws 31 to a door frame 32, a plate 33 is pivotally attached to plate 30 by a hinge 34. A spring 35 along the hinge causes the plate 33 to be urged in an out of the way position inside a recess 36 of a side 37 of the door frame. An extension plate 38 is pivotally attached by a rivet 39 on the end of plate 33.

In use, the firing mechanism is cocked by the pin being moved into the slot extension. The door is then locked in closed position, and the plate 33 is pivoted on the hinge 34 outwardly of the recess 36 so that the plate 38 can then be pivoted about the rivet 39 so that a slot 40 of plate 38 fits around the hammer pin 25. A cap 16 is loaded in opening 24. Then if the door is attempted to be swung open, the pin 25 held in the slot 40, is caused to be rotated so that is moves out of slot extension 27 and into slot 26 so thus no longer holds the spring compressed. The spring with sudden great force now thrusts the hammer against the cap, causing it to explode loudly and warn a home occupant of an attempted intrusion by a burglar. The warning wound is certain to frighten the intruder away.

A stop 41 on plate 33 holds the plate 38 from falling downward below a horizontal position. After the alarm is thus sounded. The spring 35 returns the plate 33 back into out-of-the-way position in the recess 36.

The triggering unit 18 operates generally a same as triggering unit 17 when the device is installed as shown in FIG. 2, it protects both the upper and lower window sashes 42 and 43 from being opened without an alarm. Movement of either sash 42 or 43 causes pivotal movement of pin 25 to align with slot 26 and the resultant explosion as described in regard to unit 15 and triggering device 17.

FIG. 7 shows the firing mechanism unit 15 installed on a pistol 44, wherein the pin 25 (when in a cocked position in slot extension 27) is convenient for being pushed by a person's trigger finger located in finger opening 45 of the pistol handle 46.

What is claimed as new, is:

1. A protection device for a movable closure comprising in combination a firing mechanism unit mounted on said closure, a triggering unit for activating said firing mechanism unit mounted on a fixed member and a gun-powder loaded firing cap wherein, said firing mechanism unit comprises a barrel containing a compression coil spring bearing against a closed end of said barrel and a hammer slidably mounted in said barrel, said cap being squeezed into an open end of said barrel, said spring bearing against a rear end of said hammer urging said hammer toward said cap including a sideward pin extending from said hammer slidable in a slot along a side of said barrel parallel to the barrel axis wherein said triggering unit comprises a fixed plate secured to said fixed member said plate having means retaining said pin in a cocked position compressing said spring when the closure is closed, whereby said means is adapted to release said pin when the closure is moved towards an open position thus permitting the pin to slide in said slot wherein said means comprises a retainer plate pivotally secured to said fixed plate having a retaining slot for receiving said pin, whereby said pin pivotably slidable from a transverse extension of the barrel slot retaining said pin in cocked position, to a released position aligned with the barrel slot, whereby movement of said closure member towards an open position causes the pin to pivot to said released position.

* * * * *